US005577306A

United States Patent [19]

Gold

[11] Patent Number: 5,577,306

[45] Date of Patent: Nov. 26, 1996

[54] FRICTION BASED ONE-HANDED CLOSURE AND RELEASE MECHANISM

[76] Inventor: Danny Gold, 27 Barker Road, Apt. E-2, Hong Kong, Hong Kong

[21] Appl. No.: 384,101

[22] Filed: Feb. 6, 1995

[51] Int. Cl.[6] ..... A41F 1/00

[52] U.S. Cl. ..... 24/715.3; 24/712; 24/300

[58] Field of Search ..... 24/712, 715.3, 24/713.2, 300, 30.5 R, 482

[56] References Cited

U.S. PATENT DOCUMENTS

| | | | |
|---|---|---|---|
| 891,067 | 6/1908 | Hoegren . | |
| 2,113,731 | 4/1938 | Kennedy | 24/713.2 |
| 2,336,950 | 12/1943 | Moss | 24/712 |
| 2,817,164 | 12/1957 | Gilbert . | |
| 2,832,116 | 4/1958 | Clevett, Jr. et al. | 24/30.5 R |
| 3,696,474 | 10/1972 | Slauta | 24/712 |
| 3,887,968 | 6/1975 | Lynam | 24/712 |
| 4,993,128 | 2/1991 | Gold | 24/715.3 |
| 5,224,220 | 7/1993 | Andriola . | |
| 5,263,202 | 11/1993 | Siberell . | |

FOREIGN PATENT DOCUMENTS

| | | |
|---|---|---|
| 1016793 | 4/1950 | France . |
| 156995 | 4/1939 | Germany . |
| 354798 | 12/1937 | Italy . |

*Primary Examiner*—Victor N. Sakran

*Attorney, Agent, or Firm*—Aufrichtig Stein & Aufrichtig, P.C.

[57] ABSTRACT

A one-handed closure and release mechanism for selectively shortening the dimension of an item utilizing frictional engagement of a stretchable elastic cord member and a restrictive guide structure having at least two openings. In various embodiments the elastic cord member may either be secured inside a channel or fixed within an object or garment or may have two free ends extending out of the closure mechanism. The one-handed closure mechanism operates by use of the exertion of force on the one or more free ends of the stretchable elastic cord member which results in the relative proportion of the stretchable elastic cord member inside the closure mechanism being reduced which, upon release of the tension, has the effect of causing the crushing of the object to reduce the length of the channel through which the elastic cord member extends inside of the restrictive mechanism.

25 Claims, 9 Drawing Sheets

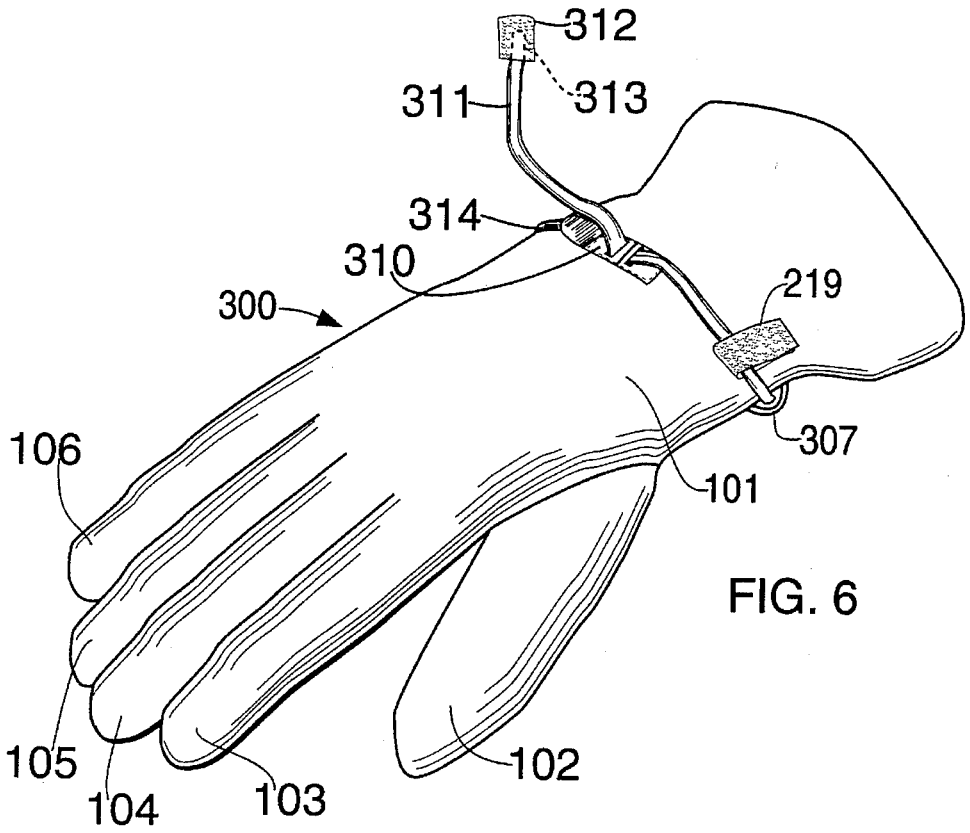
FIG. 6
FIG. 7A
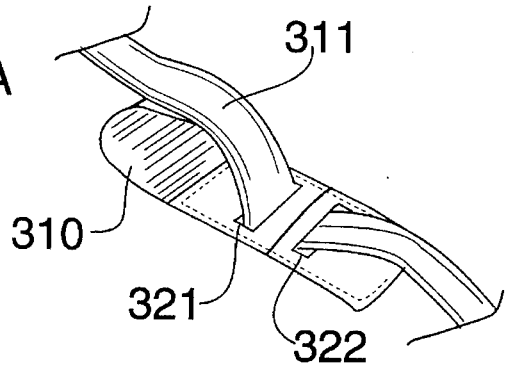
FIG. 7B
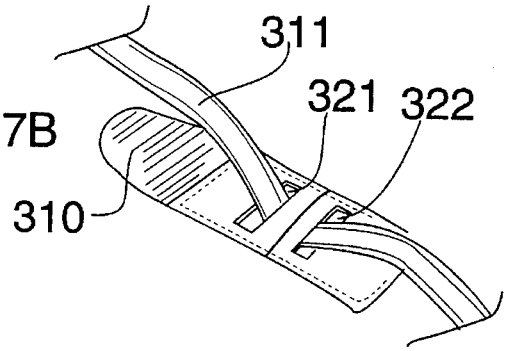

FRICTION BASED ONE-HANDED CLOSURE AND RELEASE MECHANISM

BACKGROUND OF THE INVENTION

This invention is generally directed to an improved one-handed closure and release mechanism and, in particular, to a one-handed closure and release mechanism utilizing a shockcord and closure assembly which controls the operation of the closure mechanism by frictional engagement of the shockcord and assembly. The closure mechanism is adapted for use in connection with the gauntlets of the gloves or mittens, the open ends of other garments such as coats, socks and in connection with containers such as knapsacks, handbags and the like, both proximate to an opening and around a closed portion of the garment or container.

In the past, there have been various different types of closure mechanisms utilizing straps or laces of various types. However, most of these suffer from the need to use two hands, one hand to hold the free end or ends of the lace or strap and a second hand to enable the shortening of the channel in which the closure mechanism locks the lace or strap and a gripping point. However, these closure mechanisms suffered from an inability to be operated with one hand. One hand operation is particularly critical in the glove and mitten area because one hand will be inconveniently located within the glove the closure mechanism is built into. This has the effect of making those closure mechanisms which require two hands extremely awkward, at best, to operate.

There have been various closure mechanism devices using spring loaded devices known as tonkas which are cord locks that operate only when a button at one end of the cord lock is pushed, is placed on the outside of the channel to catch the leading edge of the tape. The tonkas or other closure mechanisms attached to the outside of a channel region rely on the variable resistance of the outside of a channel region rely on the variable resistance of the spring loaded tonka or other cord lock to secure the lace or strap in place.

The instant applicant, in a prior development, now U.S. Pat. Nos. 4,864,695 and 4,993,428, invented a closure mechanism which operated by establishing a reduction in the cross-sectional area of the shockcord which restricts movement of the shockcord except in a stretched, smaller cross-sectional area state. The narrowed cross-sectional area development found in the earlier patents operates in a several step procedure initiated by the pulling on the free end or ends of the elastic shockcord. First, as the shockcord is pulled, it stretches and takes on a reduced cross-sectional area along portions of its length including a channel restricting portion of the closure mechanism. As the dimensions of the restrictive portion are set so as to allow a greater portion of the free end of the elastic shockcord to extend beyond the restriction in the channel. Next, when pressure is released from the shockcord the cross-sectional area of the shockcord enlarges back towards its at rest cross-sectional area and grips the restrictive portion of the channel with substantial biasing force which acts to grab the shockcord and hold it in place with much of the additional portion of the shockcord proximate the free end outside of the restrictive opening to the channel. The remaining portion of the shockcord inside the channel is still under stress. To relieve the stress the shockcord tends to shrink, which has the effect of shirring the material of the channel and areas around it to close the circumference of the channel. While this closure mechanism is effective and, in practice, effectively provides a one-handed closure mechanism suitable for use in gloves or mittens or small leather articles and the like, there are certain problems associated with the system. Primarily, the dimensions of the channel restriction and the cross-sectional area of the elastic shockcord requires precision sewing and assembly which can have the effect of increasing the cost and the failure rate where problems in the production schedule effect the operability of the closure mechanism. Accordingly, there is a need for an improved one-handed closure mechanism for gloves, mittens, open-ended containers and similar structures which operate in an efficient fashion and may be assembled without the need to incorporate time consuming, complicated and critical dimensional structures and which may be easily released. There is also a need for improved closure mechanisms which may be formed of various types of structures, both inside and outside of channel regions, which allow for effective one-handed closing and one-handed opening.

SUMMARY OF THE INVENTION

The invention is generally directed to a one-handed closure mechanism for selectively shortening a dimension of a crushable member. The stretchable elastic cord member encircles or is attached to a crushable member having a first outer contact surface perimeter in an unstretched state and a second outer contact surface perimeter in a stretched state. The stretchable elastic cord member has one fixed end, fixed to the crushable member and one free end. A base surface structure rests against the elastic cord member and provides frictional resistance to the movement of the elastic cord member. A restrictive guide structure has at least one or more openings. The free end of the elastic cord member extends through the opening or openings in the restrictive guide structure. The elastic cord member has a first portion of its length which is formed by the free end to the restrictive guide structure and the second portion, making up the remainder of the length of the elastic cord member, which is between the restrictive guide structure and the fixed end. Stretching the elastic cord member by pulling on the free end results in the lengthening of the elastic cord member. The elastic cord member takes on the second outer contact surface perimeter at least proximate the openings in the restrictive guide structure. When the pulling is stopped and the tension is released, this results in the increase of the perimeter to the first outer surface perimeter. The increase in the relative friction between the elastic cord member and the base of the structure and the restrictive guide structure, as well as a decrease in the length of the second portion of the elastic cord member and an increase in the original length of the elastic cord member to a length where there is the original length when the friction between the elastic cord member and the base support structure and the restrictive guide structure increases to stop the further movement of the elastic cord member through the opening or openings in the restrictive guide structure. The length of the second portion of the elastic cord member between the fixed end and the restrictive guide structure now substantially shortens and reduces the length of the crushable member. The first portion of the elastic cord structure becomes substantially longer, taking up the acquired length from the reduced length of the second portion of the elastic cord member.

The invention is also directed to an improved one-hand closure mechanism for selectively shortening the dimension of an item. It includes a stretchable elastic cord member encircling an object having a first outer contact surface perimeter in an unstretched state and a second outer contact surface perimeter in a stretched state, and the stretchable elastic cord member having two free ends. A base surface member rests against the elastic cord member and provides frictional resistance of the movement of the elastic cord member relative to the base surface member. A restrictive guide structure has at least two openings. Each free end of the elastic cord member extends through at least two openings in the restrictive cord structure. The elastic cord member has the first portion of its length which is formed by the two free ends and a section portion, making up the remainder of the length of the elastic cord member which is between the free ends and also encircles at least a portion of the object. Stretching the elastic cord member by pulling on the free ends results in the lengthening of the elastic cord member, the elastic cord member taking on the second outer contact surface perimeter at least proximate the openings in the restrictive guide structure and the relative proportion of the length of the elastic cord member making up the second portion is reduced while the actual length of the second portion remains generally unchanged. The friction between the contact surface of the elastic cord member and the base surface structure and the restrictive covering structure is insufficient to prevent to the increase in the actual length of the free ends. The release of tension on the elastic cord member when the pulling is stopped results in the increase of the perimeter of the elastic cord member to the first outer surface perimeter. This increases the relative friction between the elastic cord structure and the base surface structure and restrictive covering structure. As a result, the decrease in the length of the elastic cord member ceases when the elastic cord member has a length greater than the original length of the elastic cord member. But, the length of the elastic cord member between the ends is substantially changed, although in a stretched state, while the proportion of the elastic cord member between the free ends is reduced. Finally, the stretched portion of the elastic cord member between the free end biases the object so that the object perimeter between the free ends is reduced.

Another object of the invention is to provide an improved one-handed closure mechanism for selectively shortening the dimension of an item and thereafter releasing with one hand the mechanism so as to selectively lengthen the dimension of the item to its original size.

Still another object of the invention is to provide an improved one-handed closure mechanism and release mechanism which utilizes the variably differential surface frictional characteristics of a stretchable cord member so that upon stressing the stretchable cord member by pulling on a free end thereof the relative proportion of the length of the stretchable cord member inside the closure mechanism is reduced relative to the free end portion or portions of the stretchable cord member so that, upon release of the stretchable cord member, the portion of the stretchable cord member closing the free end retains enhanced percent of the total unstretched length of the stretchable cord member and the remaining proportion of the length of the stretchable cord member secured to the object reduces in length so that the dimension of the object is reduced. The reduction in size and dimension of the object can be reversed with a single hand overcoming the resistance between the stretchable cord member and the restrictive guide member so as to readjust the relative proportions of the free end or ends of the stretchable cord member and the remaining portion of the stretchable cord member to the original proportions so that the dimension of the object can return to its original state.

Still a further object of the invention to provide an improved one-hand closure mechanism wherein an open end of a glove or other garment has a stretchable cord member circling most of the perimeter of the opening through a channel and then, with two free ends, is threaded through a closure mechanism and then out to a common opening for frictionally restricting the opening of the glove or other garment.

Yet a further object of the invention to provide an improved one-handed closure mechanism for the end of a glove incorporating a channel encircling the glove gauntlet opening and restrictive members for threading of the free ends of the stretchable cord member in conjunction with a release mechanism which allows one-handed release of the restriction.

Yet still a further object of the invention to provide an improved one-handed closure mechanism incorporating frictional interaction between a stretchable cord member and restrictive members which utilize the frictional engagement of the surface of the stretchable cord member and the restrictive member to control closure of a glove opening, garment or container opening or perimeter or portion of a perimeter of an object through selective variably frictional engagement.

Still a further object of the invention is to provide an approved one-handed frictional interaction closure mechanism and release mechanism for reducing the dimension of a crushable object.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following descriptions taken in connection with the accompanying drawings, in which:

FIG. 4(*b*) is a perspective view similar to the view of FIG. 4(*a*) corresponding to the glove of FIGS. 1, 2 and 3 in the state of FIG. 3;

FIG. 6 is a perspective view of a frictionally based one-handed closure mechanism for a glove constructed in accordance with a third preferred embodiment of the invention, FIG. 7(*a*) is an enlarged cutaway perspective view of the closure mechanism of the glove of FIG. 6 in an unstressed state;

FIG. 7(*b*) is an enlarged cutaway perspective view of the closure mechanism of the glove of FIG. 6 where the elastic cord is under stress;

DETAILED DESCRIPTION OF THE PREFERRED EMBODIMENTS

Figure 1:
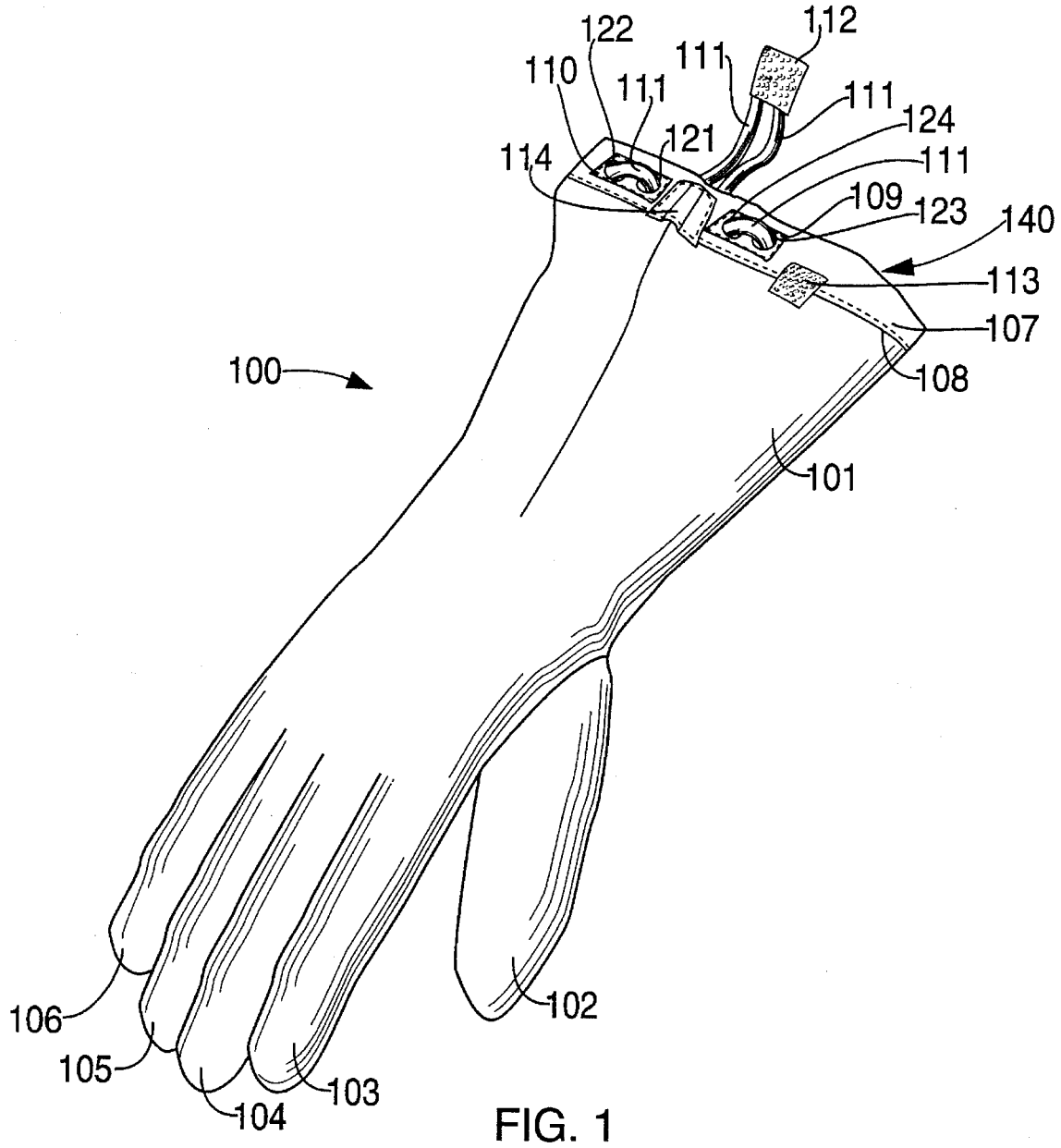
FIG. 1 is a perspective view of a glove incorporating a frictionally based one-handed closure and release mechanism constructed in accordance with a first preferred embodiment of the invention.

Reference is made to FIG. 1 wherein a glove with a single handed closure and release assembly constructed in accordance with a preferred embodiment of the invention, generally indicated as 100, is depicted. Assembly 100 includes a glove 101 having thumb portion 102 and fingers 103, 104, 105 and 106. At the open end of the gauntlet of glove 101, a channel 107 is formed by overlapping material and securing it to the end of glove 101 along stitching line 108. Channel 107 has frictional restrictive members 109 and 110 secured to the outside of channel 107 proximate to an opening 125 in channel 107. Frictional restrictive members 109, 110 have openings 123, 124 and 121, 122, respectively. Openings 121, 122, 123 and 124 communicate between the inside of the channel and the outside of restrictive mechanisms 109, 110. A stretchable elastic shockcord 111, in a preferred embodiment having a circular cross-section enters channel 107 at opening 125, exits channel 107 at opening 121, reenters channel 107 at opening 122, exits channel 107 at opening 123, reenters channel 107 at opening 124 and finally reemerges from channel 107 at opening 125. The two free ends of shockcord 111 are secured together by end gripper assembly 112 which also includes a mating hook or pad removable connector which is adapted to engage with and mate onto matching pile or hook pad 113 secured to the gauntlet of the glove proximate the channel 107.

A piece of natural or synthetic leather or other material 114 is secured near the channel 107 in the region of the gauntlet between the two restrictive connectors 109, 110. Leather grip 114 is sewn so as to provide an easy grip between thumb and opposed finger.

FIG. 1 shows glove closure assembly 100 in its opened state, with channel 107 at its maximum length so that a wearer's hand (not shown) can be most easily inserted into the open end of glove 101. The portion of stretchable elastic member 111 trapped within the channel between openings 123 and 122 (the "trapped portion"), is in its unstretched state.

Figure 2:
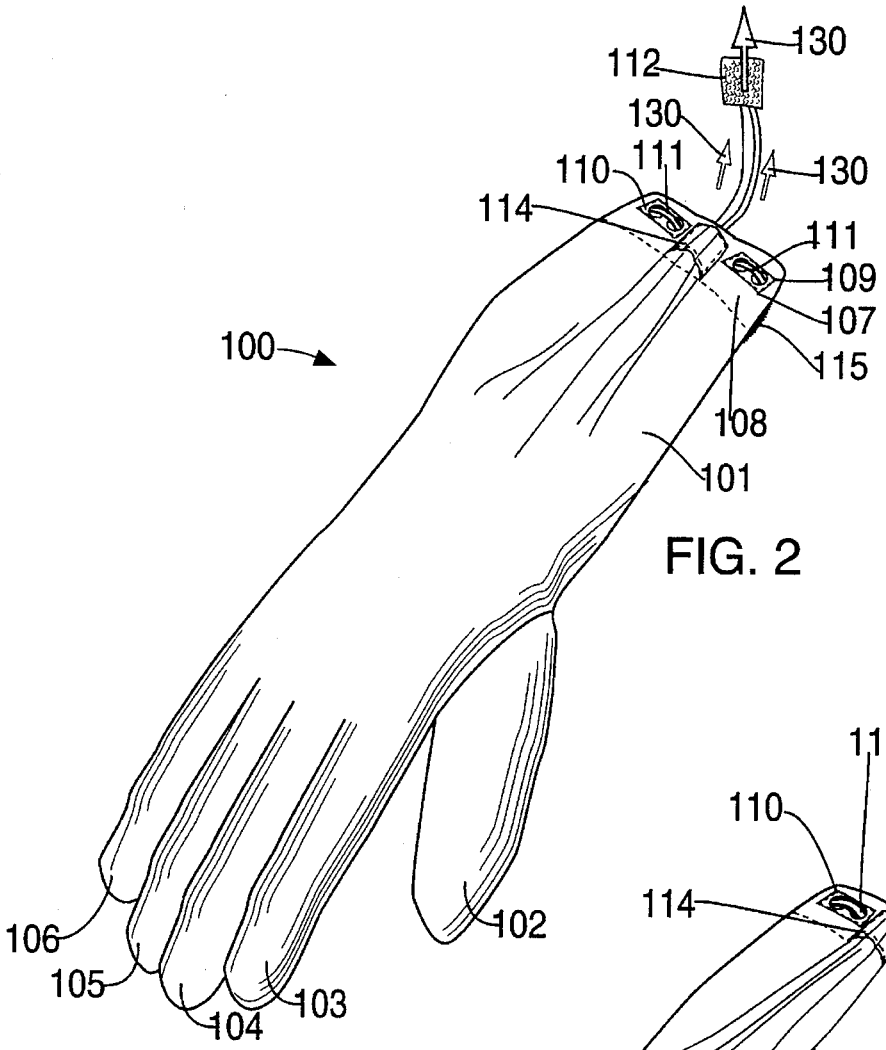
FIG. 2 is a cross sectional view of the glove of FIG. 1 wherein the free end drawstring has been pulled to close the opening.
Figure 4A:
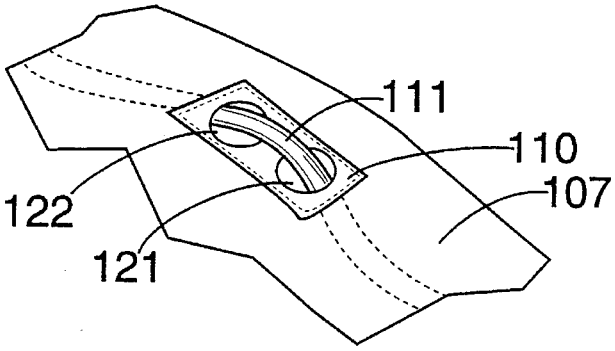
FIG. 4(*a*) is a cutaway perspective view of a portion of the closure mechanism of the glove of FIG. 2.
Figure 4B:
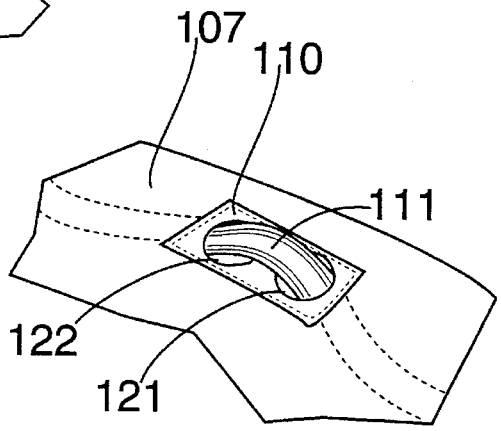

Reference is next made to FIG. 2 wherein the same glove with one-handed closure assembly and release 100 is shown as pad 112 is pulled in the direction of arrows 130. Like referenced numerals refer to like elements. As pad 112, coupled to the free ends of shockcord 111 are pulled upward in the direction of arrows 130 several things occur. First, the total length of shockcord 111 increases. However, during this phase, the length of channel 107 about the periphery of the open end of the gauntlet of glove 101 remains relatively constant in length. Any shortening of the length of channel 107, or the trapped length of elastic stretchable member 111 in this stage is incidental. As best seen in FIGS. 4(*a*) and 4(*b*), which shows in enlarged cutaway views, the operation of restrictive member 110 in combination with elastic shockcord 111 which enables the one-handed operation of the closure mechanism is clarified. FIG. 4(*b*) shows the elastic shockcord 111 in its unstressed position. In this unstressed position the diameter of shockcord 111 and its perimeter are in an unstressed size. In FIG. 4(*a*), elastic shockcord 111 is shown in its stretched state when stress is exerted along the length of shockcord 111. This has the effect of increasing the overall length of shockcord 111 and reducing the cross-sectional area and perimeter of shockcord 111 to a second, stressed size which is smaller in cross-sectional area and perimeter than the first, unstressed size. It is noted that openings 121 and 122 in restrictive member 110 are larger in circumference than shockcord 111, even in its unstressed state (FIG. 4(*b*)). However, examination of the amount of frictional engagement of shockcord 111 and the surfaces of restrictive member 110 vary from FIG. 4(*b*) to FIG. 4(*a*). In FIG. 4(*b*) there is an engagement with both sides of opening 121 and both sides of opening 122. Examining FIG. 4(*b*) and utilizing the right side of FIG. 4(*b*) as the starting point, the surface of shockcord 111 extending upward out of the page engages the right half of the opening 121 while the lower surface (i.e. the direction extending into the plane of the paper upon which FIG. 4(*b*) is drawn), engages with the bottom surface of shockcord 111 engaging with the right to the surface of opening 122 and the top surface of shockcord 111 engaging with the left end of opening 122. While the frictional force exerted between shockcord 111 and frictional restrictive member 110 varies to some extent based upon the material out of which each of these elements is constructed, the friction exerted between shockcord 111 and restrictive member 110 is directly proportional to the surface area of frictional engagement of these elements. Without attempting here to quantify the relative variability of the change in friction, one can immediately note that the stretched state of shockcord 111, shown in FIG. 4(*a*) has considerably smaller area of frictional surface area engagement than does the unstretched state shown in FIG. 4(*b*).

The effect of this variability in frictional engagement does not rely upon a compressive force which attempts to restrict the cross-sectional area of shockcord 111 as prior art devices, including applicant's prior closure mechanisms, have done. Instead, as shown in FIG. 2, when pressure is exerted on the free ends of shockcord 111, the shockcord 111 is stretched beyond its unstretched length, the shockcord takes on its stretched size between the free ends and particularly in the areas of restrictive mechanisms 109, 110 (as shown in FIG. 4(*a*)), and, as a result of the reduction in friction between shockcord 111 and restrictive mechanisms 109, 110, this has the effect of allowing shockcord 111 to slide relatively freely through restrictive members 109 and 110 with only a relatively limited shortening of the perimeter of channel 107. However, as tension on shockcord free ends 112 is released, the shockcord 111 begins to again compress toward its unstretched state, its cross-sectional area, perimeter and thus frictional area of contact with frictional restrictive members 109 and 110 increases until frictional force exerted between shockcord 111 and restrictive closure members 109 and 110 is at least equal to the internal biasing force on shockcord 111 to return to its unstressed state. Thereafter, the portion of shockcord 101 within channel 107 continues to compress back to its original unstretched length against the stiffness of channel 107. Because channel 107 is formed of a crushable material such as a light weight nylon or similar natural, artificial or mixed fiber materials, the channel crumples so as to decrease the perimeter of the channel until it fits snugly about the wearer's hand or wrist and the closure mechanism reaches a stable position. It is noted that after stretchable cord 111 ceases to move relative to restrictive members 109 and 110, the continuing shortening of stretchable 111 has the effect of further increasing the perimeter and, thus, frictional surface area so that shockcord 111 is held even more securely within restrictive closure menders 109 and 110.

In practice, the one-handed closure mechanism operates in a two stage process. In the first stage where pressure is exerted at the free ends of stretchable member 111, the overall length of the stretchable cord member is increased, and the length of the stretchable cord member within the channel remains generally the same length. However, the unstretched length of the portion of the stretchable member 111 found within the channel is substantially less than the original length of the channel. Thereafter, the frictional engagement of the stretchable cord member and restrictive members 109, 110 progressively increases and quickly causes the elastic cord member 111 to stop moving relative to the frictional closure mechanisms 109 and 110 as soon as the pressure is released, and finally the channel crushes down around the wearer's hand or wrist until a snug, firm grasp stops the further restrictions in perimeter size.

This firm engagement is only possible in a one-handed closure mechanism if the noted structure is used in connection with a stretchable elastic member having the noted characteristics of lengthwise extension resulting in a reduction in cross-sectional area and, more importantly, surface area, which reduces the frictional engagement of the stretchable cord member.

Figure 3:
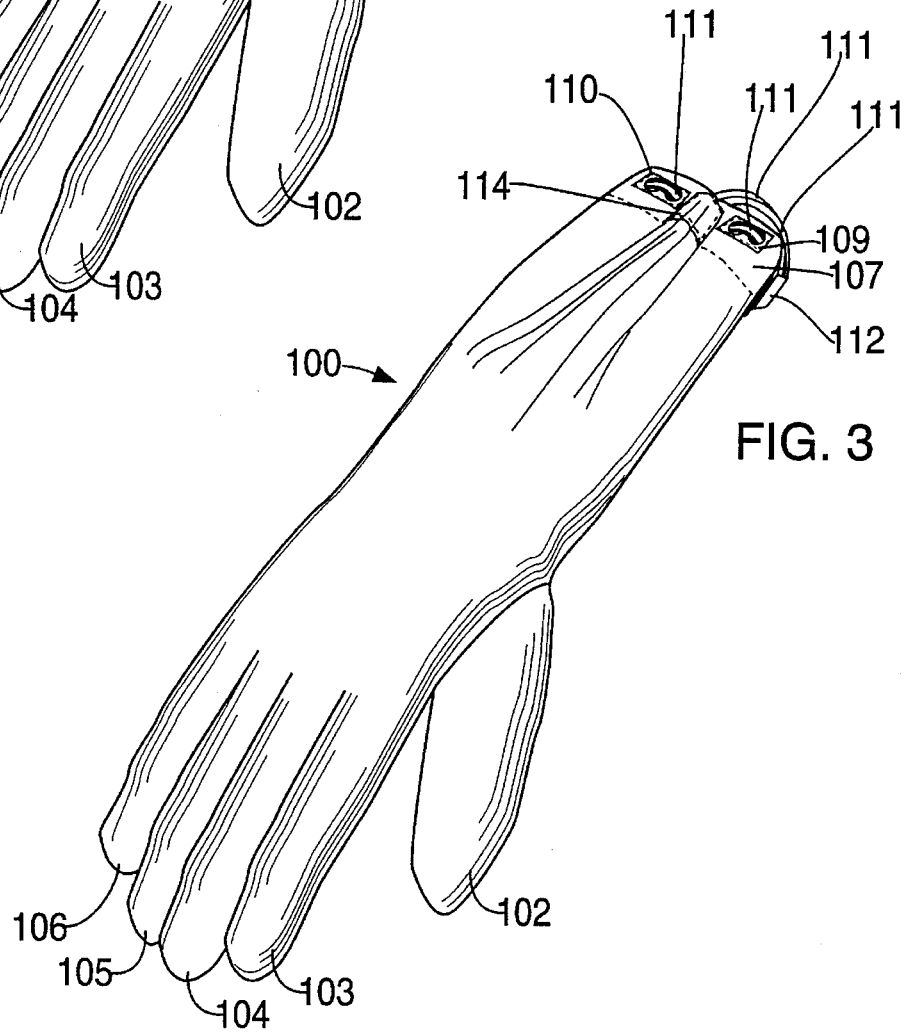
FIG. 3 is a perspective view of the glove of FIGS. 1 and 2 wherein the free end of the drawstring has been released and then secured in place on the glove.

FIG. 3 shows the glove assembly 100 in a state in which the length of channel 107 has been substantially reduced so that it is snug about a wearer's hand or wrist (not shown) and the hook or pad connector 112 on the free ends of elastic cord member 111 is secured in place with its mating element 113. This mating has the dual positive effect of keeping the free ends of cord 111 out of the wearer's way and acting as a further guard against inadvertent release of shockcord 111.

In practice, FIG. 3 represents the form that the single-handed closure mechanism glove 100 takes when the gauntlet portion has been closed utilizing the one-handed closure mechanism. When it is desired to remove the glove or merely to release the snug attachment of channel 107 around the wearer's hand or wrist, the mating relation of pads 113 and 112 is terminated by separation. This allows the free ends of cord 111 to hang freely. Then, release member 114 is gripped, generally between the thumb and forefinger or middle finger and pressure is exerted upward, out of the plane of the sheet on which FIG. 3 is drawn until sufficient additional length is added to the trapped portion of the stretchable elastic member 11 and perimeter of channel 107. By exerting an upward force between restrictive members 109 and 110, release member 114 uncrushes and stretches channel 111 so that additional portions of shockcord are drawn into the channel through openings 121-124.

Rather than utilizing the same procedure in the mechanism for tightening the closure mechanism around the wearer's hand or wrist, release mechanism 114 operates by strategically increasing the force. Release mechanism 114 in a preferred embodiment is formed of leather pads sewn in a folded over position to the back of glove 101. In a preferred embodiment, release member 114 is formed of a flexible leather material which is easily grabbed by gloved fingers. Alternatively, it can be made of natural or synthetic fiber material or a polymeric or rubber material. Essentially, the only requirement is that it be placed close to restrictive frictional members 109 and 110 and be easily gripped with either a bare or gloved pair of fingers.

Figure 5:
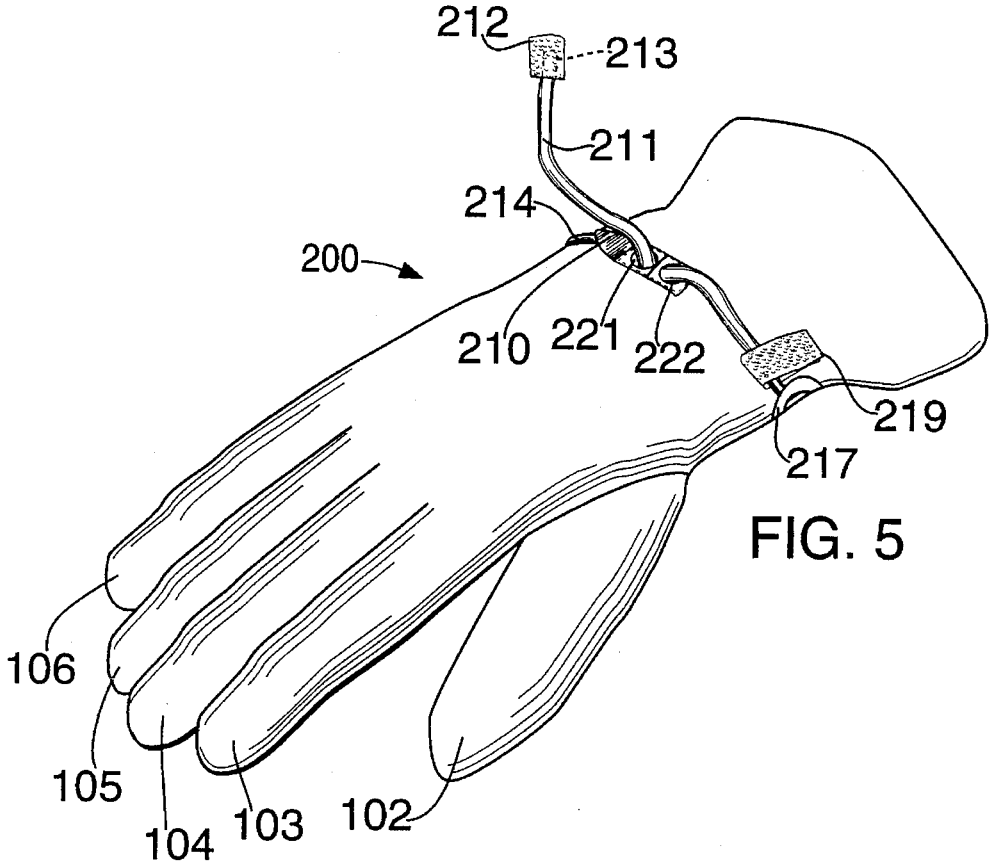
FIG. 5 is a perspective view of glove incorporating a frictionally based one-handed closure and release mechanism constructed in accordance with a second preferred embodiment of the invention.

Reference is next made to FIG. 5 wherein a one-handed closure and release assembly for a glove constructed in accordance with another preferred embodiment of the invention generally indicated as 200, is depicted. Like elements are represented by like numerals. Assembly 200 includes a glove 101, including thumb portion 102 and finger portions 103, 104, 105 and 106. In closure assembly 200, there is a single frictional restrictive member 210. In addition, elastic shockcord 211 has only a single free end 213 which has a hook or pad connector attached to the free end 213. The other end of elastic cord 213 is sewn or otherwise attached to the outside of glove 101 proximate to connector 210. This fixed end 214 is held in place by stitching, gluing or other conventional means for fixing. In one preferred embodiment, the elastic shockcord 213 wraps around the outside of glove 101 around the wrist portion of the glove. In another preferred embodiment, a channel such as is found in the embodiment of FIGS. 1–4(*b*) is utilized to guide and cover the portion of shockcord 213 as it extends across the inside or palm side of glove 101. If no channel is used then one or two belt loops may be utilized to guide elastic cord 213 around the palm portion and side of glove 101.

As shown in FIG. 5, a belt loop 217 guides elastic 213 so that it remains in alignment with restrictive member 210. Member 210 is similar to restrictive element 110 but there are differences. The first difference is the manner in which shockcord 213 is threaded through openings 221 and 222 in 222. Whereas in the embodiment in FIGS. 4(*a*) and 4(*b*), noted above, shockcord 113 enters restrictive structural element 110 from the bottom (from within the channel), extends upwardly through opening 121, continues above structural member 110 and then reenters the channel downwardly through opening 122. As described above, this results in a frictional engagement between the shockcord 113 and the side surfaces of openings 121, 122 of structure 110, as well as a frictional engagement between shockcord 113 and a small portion of member 110 between openings 121 and 122.

In contrast, in the embodiment of FIG. 5, shockcord 213 enters restrictive element 210 with a downward entry through opening 222, lateral extension between the bottom surface of 210 and the top (or back of the hand) portion of glove 101 and then extends upwardly through opening 221 where free end 213 and connector 212 is found. In addition to the frictional engagement between shockcord 211 and the sides of openings 221 and 222, which is the same as with the embodiment shown in FIGS. 4(*a*) and 4(*b*), there is also friction against the bottom portion of the surface of the frictional restrictive member 210 (on its bottom) between openings 221 and 222, there is also frictional engagement of the bottom surface of shockcord 211 with the back of glove 101. The back surface of glove 101 can be formed of a suitable fabric which provides a desired level of frictional engagement to allow easy one-handed closure of the glove about the wearer's wrist by pulling on pad 212 at the free end 213 of elastic member 211.

As described above, with reference to FIGS. 4(*a*) and 4(*b*), when a wearer of glove 101 pulls on the free end 213 of elastic stretchable member 211, generally by gripping between the thumb and forefinger pad 212, the elastic stretchable member 211 extends its overall length and reduces its perimeter and, thus, cross-sectional area frictionally engaging with the surfaces of restrictive member 210 and the back surface of glove 101 so that the elastic cord member slides freely. This results in the relative proportion of the elastic cord member 211 between the fixed end 214 and opening 222 being reduced relative to the overall length of the glove, although shortening of this dimension by a small amount is possible. Thereafter, as force is released at free end 213 of elastic member 211, the size of the perimeter of elastic member 211 increases which has the effect of also increasing the frictionally engaging area between shockcord 111 and resistive 110 and glove 101.

As with the embodiment described above in connection with FIGS. 1–4(*b*), the embodiment of FIG. 5 allows shockcord 211 to slide freely through frictional restrictive member 110 only until the resistive force equals the compressive force of the stretchable cord member 211 at which point the stretchable cord member 211 locks in resistive member 210, the portion of glove 101 encircled by shockcord 111 crushes inwardly until snugly secured around the wearer's wrist. As the glove 101 crushes inwardly the distance around the perimeter of glove 101 decreases, thereby relieving more of the internal compressive stress of stretchable member 211 so that the locking effect of the restrictive closure member 110 is further improved. Thereafter, pad 212 is then made into a looped pad 219, which is looped around stretchable member 211 between guiding loop 217 and restrictive member 210 so that free end 213 of strap 211 does not swing freely. It also aids in preventing any further loosening of strap 211 through frictionally resistive member 210. Member 219 has mating pad or hook members to mate with the corresponding hook or pad members on pad 212.

In addition, to the one-handed operation of the closure mechanism described above, a similar one-handed release mechanism is implemented in accordance with the structure described. First, the mating hook and pad fasteners 212 and 213 are separated by pulling upward on pad 212 or on stretchable pad member 211 proximate to free end 213. Then, pad 219 is gripped between the thumb and fingers of the wearer's other hand and pulled upwardly to overcome the frictional resistance and increase the length of the elastic cord member 211 between closure member 210 and the fixed end 214. This has the effect of releasing the pressure and grip around the wearer's wrist for removal of the glove from the wearer's hand without tension or stress.

Reference is next made to FIG. 6, and 7(*a*) and 7(*b*) wherein a one-handed closure and release mechanism for a glove constructed in accordance with still another preferred embodiment of the invention, generally indicated as 300, is depicted. Like reference numerals correspond to like elements. Glove 101 having thumb and fingers 102,103, 104, 105 and 106 includes a stretchable elastic member 311 secured at a first end 314, known as the fixed end, proximate to a frictional restrictive member 310. The free end of stretchable elastic member 311 extends through a channel 307 across the width of the palm side of glove 301. Restrictive frictional member 310, seen best in FIGS. 7(*a*) and 7(*b*) is secured to the outside of the glove in the area of the wrist.

As seen most clearly in FIG. 7(*a*) and 7(*b*), elastic stretchable member 311 has a flat rectangular cross-section, rather than the generally circular cross-sectional area of shockcord 111 in the prior embodiments. Adapted to this type of shockcord, slots 321 and 322 in frictional engagement member 310 are formed as generally rectangular slots. They function in a similar fashion to the rounded cross-sectional area of stretchable member 311.

As shown in FIG. 7(*a*), when the carrier elastic or braided elastic member is in a relaxed or unstretched condition then the cross-sectional area is at its maximum and resistance is likewise at a maximum level. When free end 313 of stretchable cord 311 is stretched the stretchable cord member 311 takes on a flattened, narrowed shape as shown in FIG. 7(*b*). From FIG. 7(*b*) it is quite clear that the area of frictional contact between stretchable cord member 311 and frictional member 310 in glove 101 is substantially reduced.

The same two-step closure operation is performed as in connection with embodiments of FIG. 5 and FIGS. 1–4(*b*). Likewise, release is also a single-handed operation in which, upon the release of pad 212 from mating pad 219, the shockcord elastic 311 is performed by pulling on pad 219.

Figure 8:
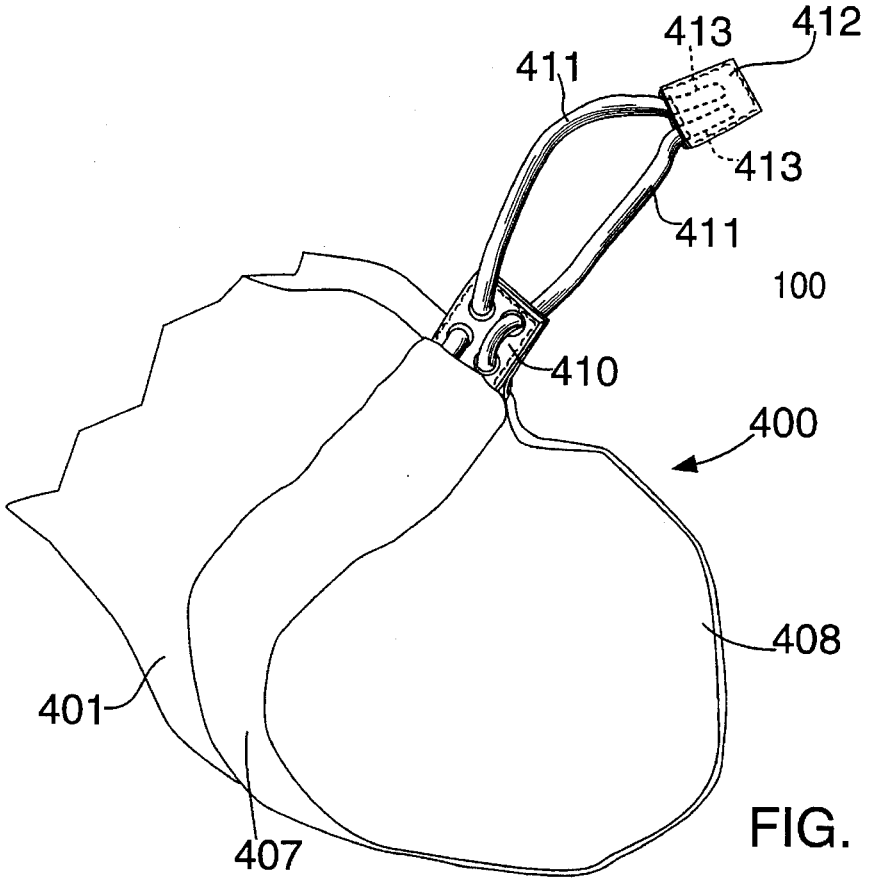
FIG. 8 is a cutaway perspective view of the gauntlet of a glove incorporating a frictionally based one-handed closure and release mechanism constructed in accordance with a fourth preferred embodiment of the invention.
Figure 9:
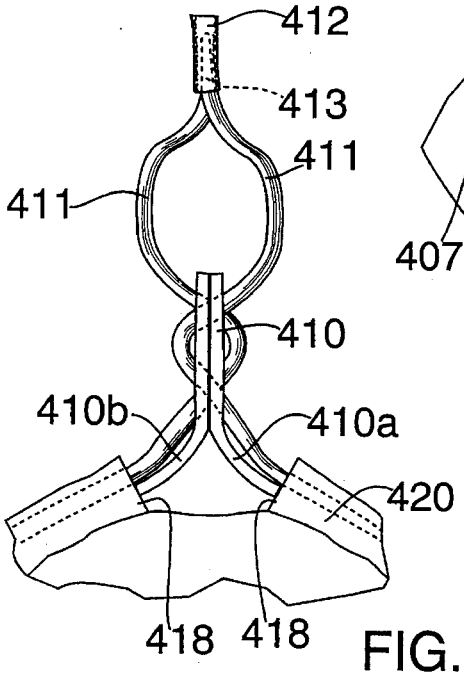

Reference is made to FIGS. 8 and 9 wherein another closure mechanism, generally indicated as 400 and constructed in accordance with another preferred embodiment of the invention is depicted. In this case, closure mechanism 400 resides on a garment, such as a glove or sleeve terminating in a gauntlet section with enclosed channel 407. In the embodiment of FIGS. 8 and 9, the frictional restrictive element 410 is a double piece of leather or other suitable material sewn together at the top half which has four openings 421, 422, 423 and 424 (FIG. 8) and has separate winged portions 410*a* and 410*b* which extend into channel 408 on both sides and are secured within channel 408.

In operation, handle 412 is gripped between the thumb and forefinger, stretching shockcord 411 in the same way as described above with the two-step process in which the gripping action occurs after release of the stretching pressure. To release the gripping pressure one merely grips restrictive member 410 between thumb and forefinger without gripping the elastic and pulls along the direction of the joined upward portion of restrictive member 410. While closure mechanism 400 shown in FIGS. 8 and 9 includes two openings in each path of stretchable member 411, this may be changed to three or more openings for each one of stretchable member 411. The mechanism 400 releases by gripping frictional restrictive member 410, without gripping the elastic stretching member 411 and pulling upward, which increases the amount of trapped stretchable elastic member 111.

Figure 10:
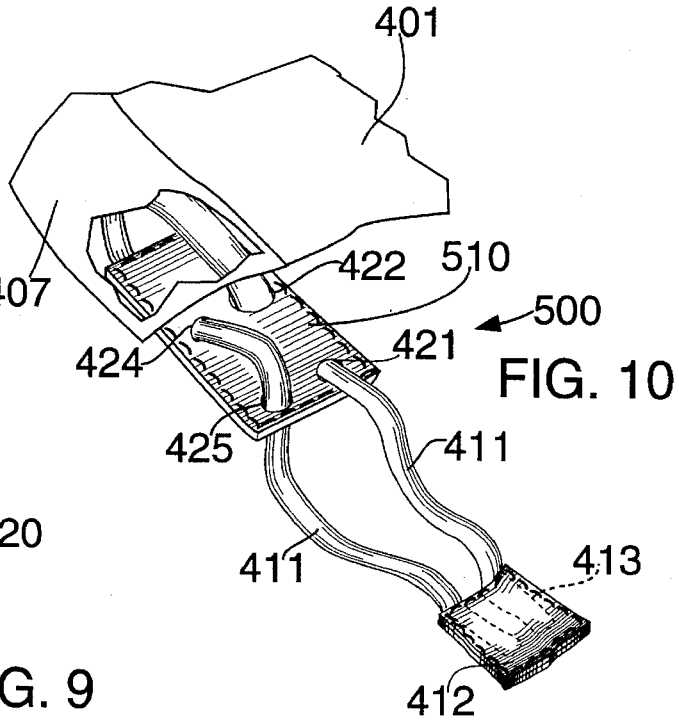
FIG. 10 is a partial cutaway perspective view of the closure mechanism of FIGS. 8 and 9.

Reference is next made to FIG. 10 wherein a closure mechanism generally indicated as 500 constructed in accordance with another preferred embodiment of the invention is depicted. Like elements are represented by like referenced numerals. A closure restricting member 510 having openings 421, 422, 423 and 424 is secured inside a channel encircling a garment or other object. The free ends of the stretchable elastic member 411 extend out of closure member 510. The other ends of the stretchable elastic member extend around the channel. Only one side of the channel is shown. The portion of the channel receiving stretchable elastic member 411 extending downward through opening 424 is not depicted but is shown in prior figures. Closure mechanism 510 is secured a short portion within the channel such as by stitching. The operation of the closure mechanism is similar to those described above with a pull on handle 412 and then release following the pulling to complete the one-handed closure operation. The one-handed release operation is enabled by pulling outwardly on closure restricting member 510 without holding onto the stretchable cord member 411.

Figure 11:
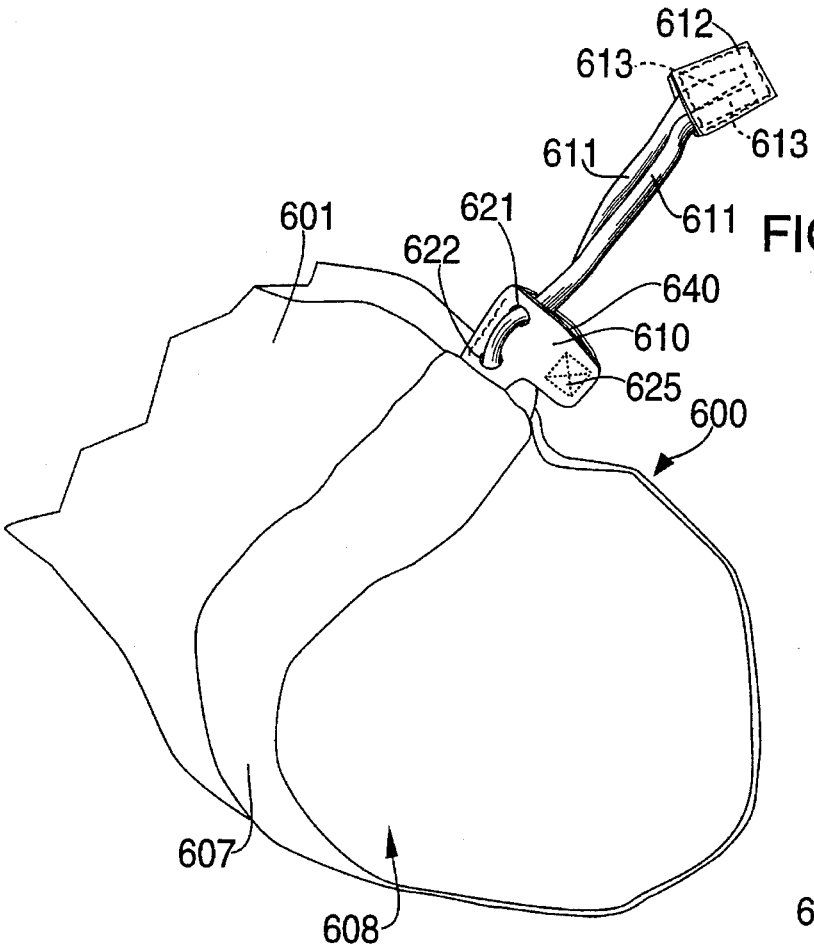
FIG. 11 is a perspective view of a portion of a closure mechanism attached to a crushable object for securing and releasing with one hand.
Figure 12:
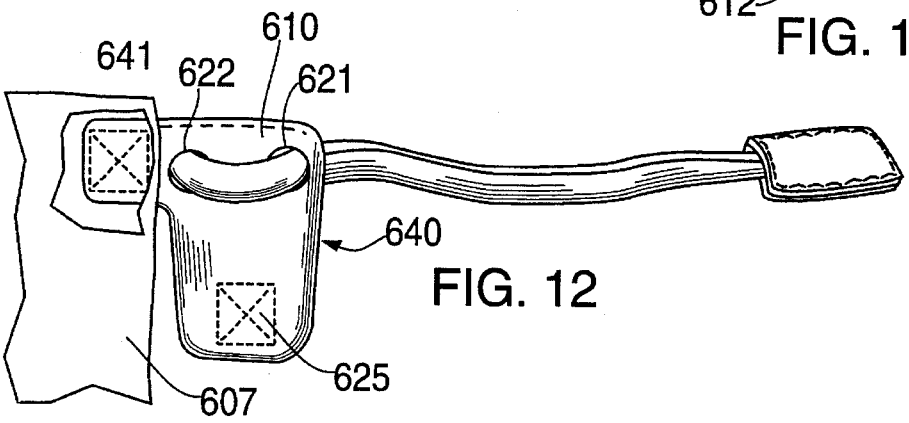
FIG. 12 is a cutaway perspective view of the closure mechanism of FIG. 11.

Reference is next made to FIG. 11 wherein a frictional closure and release mechanism constructed in accordance with another preferred embodiment of the invention, generally indicated as 600, is depicted. Closure and release mechanism 600 is depicted in connection with the end of either a glove, sleeve or a flexible walled container, such as a handbag or satchel. The object has a thin walled crushable end 601 with a finished channel 607 substantially encircling opening 608 at the end of the garment or container. A frictional restrictive member 610 is secured to the inside of channel 607 by stitching 641, as best seen in FIG. 12 (which includes a cutaway portion of channel 607). A stretchable elastic cord member 611 extends throughout the entire channel region, and both free ends 613 of strap 611 enter the inwardly pointed end of frictional resistive member 610 in the open region 627 formed between upper stitching 626 and lower stitching 625. One of the free ends of the straps winds outwardly through opening 622 and then back through opening 621 into open area 627 before exiting another opening 640 at the other side of frictional restrictive member 610. Likewise, the other free end of strap 611 exits the open area 627 through opening 632 and then reenters through opening 631 before finally exiting frictional restrictive member 610 at end 640. Then, free ends 613 of stretchable member are secured to each other and prevented from reentering frictional restrictive member 610 by a closure pad 612.

Figure 13:
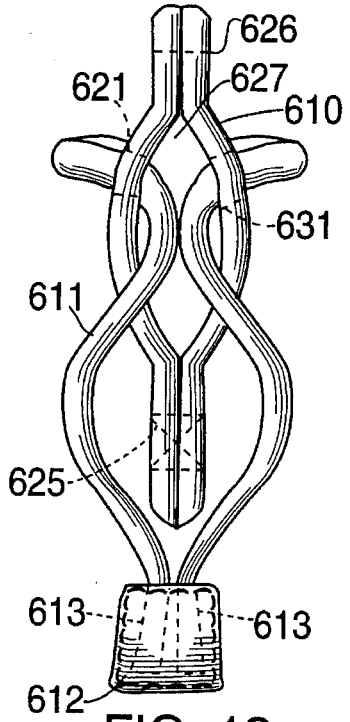
FIG. 13 is a side elevational view which shows the mechanism in FIG. 11.

As best seen in FIG. 13, stretchable cord member 611 undergoes frictional engagement with restrictive frictional member 610 as it enters and exits openings 621, 622, 631 and 632. In addition, there is resistive frictional engagement as strap 611 exits both sides of frictional resistive member 610 between both stretchable member 611 and the inner surfaces of restrictive frictional member 610 and the two free ends of stretchable member 611. This structural arrangement operates in a similar fashion to those described above in which a pull exerted on the free ends 613 of stretchable member 611 by pulling on pad 612 has the effect of increasing the length of the stretchable elastic member 611 and thereby reducing its outer perimeter and thus the frictionally engaging surface area of stretchable elastic 611, which resistance is overcome when the strap is pulled. Thereafter, as the strap is released, the frictionally engaging surface area of strap member 611 increases quickly and stops stretchable elastic member 611 relative to frictional restriction member 610 which finally results in the depression through crushing of channel 607 and the end of circular member 601 so that the size of opening 608 is substantially reduced to a lesser size. To the extent that a hand or arm is placed through object 601 and extends out of opening 608, the channel 607 crushes until a snug fit is obtained.

The one-handed release of the closure mechanism 600 is obtained by placing one's thumb and forefinger on sewn pad 625 on restrictive frictional member 610 and pulling outward toward the free ends 613 of elastic member 611. This has the effect of forcing additional portions of the stretchable elastic member through frictional restrictive member 610 so that the trapped portion of the stretchable elastic member 611 increases so that the size of opening 608 and channel 607 are returned to their original unstressed or open states.

In a preferred embodiment restrictive frictional member 610 is formed of a leather or synthetic leather held together by stitching. The dimensions of opening 621, 622, 631 and 632 are not critical and may in a preferred embodiment be larger then the unstretched cross-sectional area of stretchable member 611. The frictional engagement is not caused by the gripping of any single opening or passageway. Rather, the total frictional force is dependent upon the total frictionally engaging surface area of the elastic member against the frictionally restrictive member sides and openings and the elastic member's frictional engagement with itself. While stress is asserted on the stretchable cord member it stays in its stretched state and slides freely through the frictional restrictive member. However, when the pressure is released the elastic member very quickly increases its frictionally engaging surfaces, likely in a greater than linear relationship so that well prior to the return of the stretchable cord member to its original orientation (pre-stretching) it becomes locked within restrictive frictional member 610 and the portion of the stretchable cord member trapped within the ends continues to return to its unstretched length thereby crushing the fabric in the channel and surrounding areas so as to provide a firm closure in the region of the channel.

Figure 15:
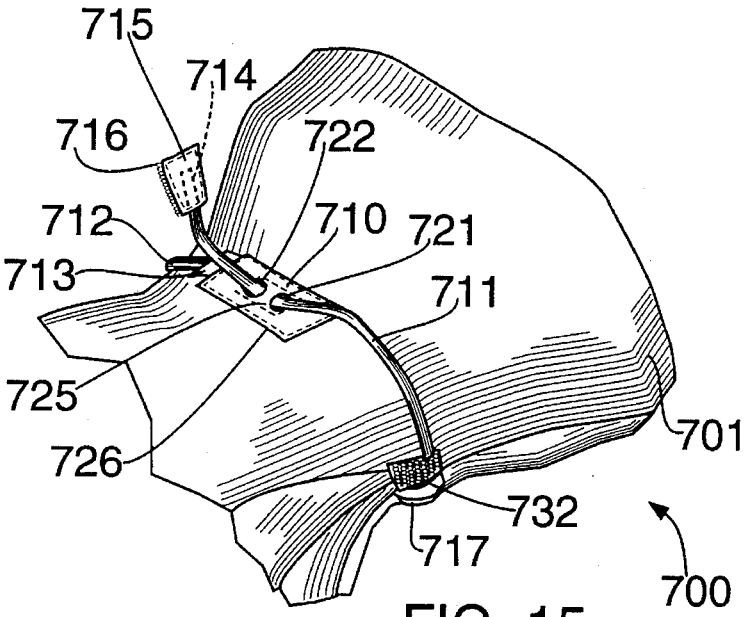
FIG. 15 is a perspective view of a closure and release mechanism utilizing frictional engagement constructed in accordance with another preferred embodiment of the invention.
Figure 14:
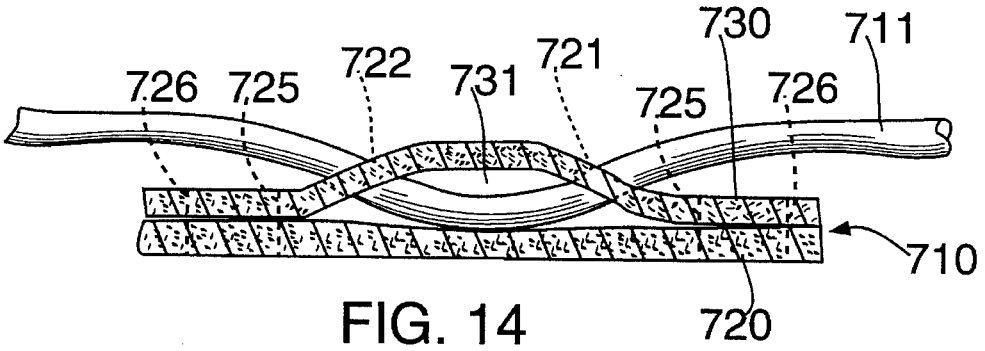
FIG. 14 is a cutaway side elevational view of a closure mechanism in accordance with another preferred embodiment of the invention.

Reference is next made to FIGS. 14 and 15 wherein a closure mechanism adapted for one-handed closure and release generally indicated as 700 constructed in accordance with another preferred embodiment of the invention is depicted. Closure mechanism 700 is placed in connection with a generally cylindrical crushable member 701. Closure mechanism 700 includes a restrictive friction member 710, stretchable elastic member 711, having a fixed end 712 secured in place by a leather covering 713. In a preferred embodiment the covering is leather although this is not necessary. A free end 714 of the elastic cord member has a gripping member 715 sewn on to free end 715. A mating releasable connector, such as a hook or pad of Velcro type connective 716 is secured to one surface of the pad 715. In addition, the portion of the encirclement of member 701 by elastic member 711 on the bottom of the view of FIG. 15 includes a channel 717 which acts to guide the placement and location of elastic member 711.

The free end of elastic member 711 enters frictional restrictive member 710 in an opening 721, extends between upper surface 730 and lower surface 720 of frictional closure member 720 and then exits the gap between layer 730 and 720 in opening 722. Opening 721 and 722 need not be of a critical size and in a preferred embodiment are from slightly to somewhat larger than the cross-sectional are of elastic member 711 in its unstretched form. It is also possible for the openings to be approximately the same size or even slightly smaller than the unstretched cross-sectional area of elastic member 711.

As best seen in FIG. 14, a first stitching seam 725 forms a rectangular area surrounding opening 721 and 722 and allows for chamber 731. In addition, frictional restrictive member 710 is sewn with seam 726 generally around its periphery to a portion of a crushable layer 701. Finally, a loop of material 732 encircles stretchable elastic member 711 between opening 721 and the start of channel 717. Loop 732 is formed with an outer mating connector surface such as a hook or pile connector.

In use, the wearer pulls on handle 715 affixed to the free end 713 of stretchable elastic member 711 until the stretchable member is extended sufficiently to encircle crushable cylindrical member 701 sufficiently to allow engagement of the mating connectors 716 and 732.

Figure 16:
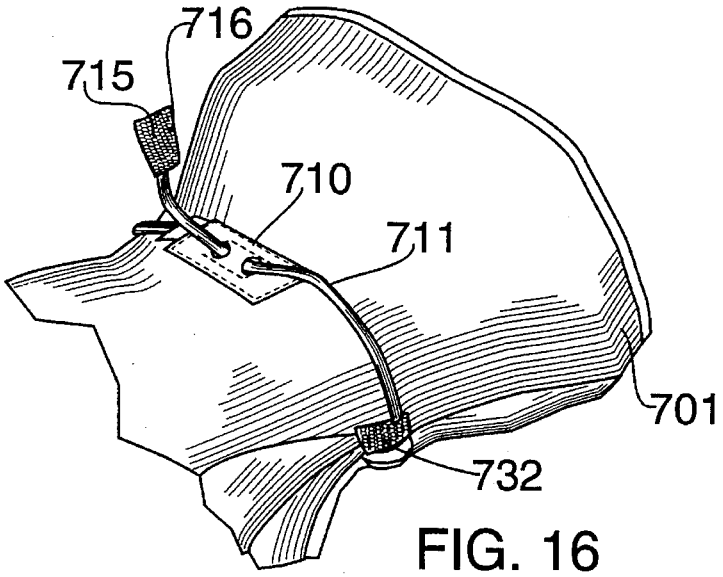
FIG. 16 is a perspective view of a closure and release mechanism utilizing frictional engagement constructed in accordance with a further preferred embodiment of the invention.

In contrast, in the embodiment of FIG. 16, the pad 715 may be rotated so that mating connector 716 faces loop connector 732 with its mating connectors across frictional restrictive member 710 and when the pad 715 is pulled directly toward looped connector 732. Wherever pad 715 reaches looped connector 732 is slid along elastic member 711 to mate with mating connecting member 716.

Thus, depending upon the extent to which crushable cylindrical member 701 must be reduced in cross-sectional area, either the approach of FIG. 15 or FIG. 16 can be pursued without any change in structure. Generally, on most applications, the approach of FIG. 16 is preferred as there is no need to have a loose section of stretchable cord 711 outside of channel 717 as would be required by the embodiment of FIG. 15.

We note that frictional restrictive member 710, along with an elastic member 711 is an essentially closed system in which all frictional engagement in the system is controlled within frictional restrictive member 710. Thus, this embodiment can be used in a variety of different applications, for: encircling a cylindrical area, such as at the wrist or gauntlet of a glove; at the opening of a handbag; at the waist of a jacket; around the ankles of pants; or even to constrict portions of a crushable member between two fixed points.

The fixed end 712 could be fixed at the location of the start of channel 717 as shown in FIG. 15 and similar operational perimeters would exist. The only difference is that the compression of the crushable surface would only be between the fixed end and the first opening of the frictional restrictive means.

The one-handed release operates by gripping loop 732 between the thumb and forefingers and pulling on it so that the additional portion of stretchable cord member 711 between opening 722 and free end 714 is reduced, thereby increasing the cross-sectional area of generally cylindrical member 701 proximate to closure member 700.

Figure 17:
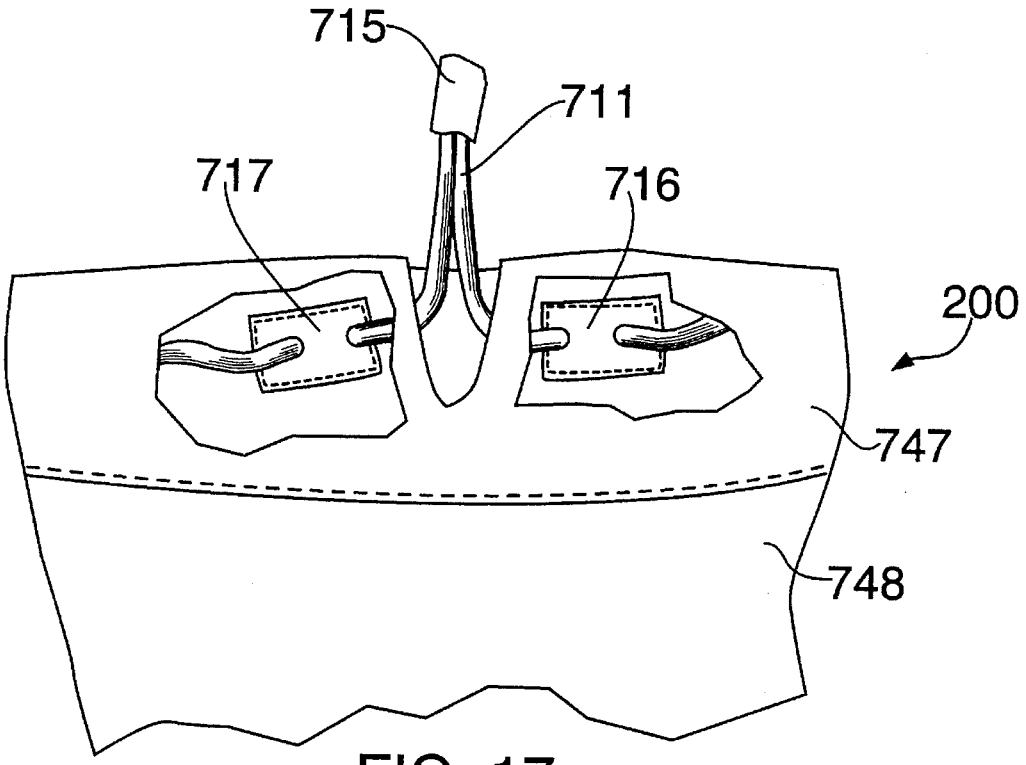
FIG. 17 is a cutaway perspective view of a closure and release mechanism constructed in accordance with another preferred embodiment of the invention.

Reference is next made to FIG. 17 wherein a one-handed closure and release mechanism constructed in accordance with another preferred embodiment of the invention, generally indicated as 800, is depicted. Like reference numerals representing like elements. Closure mechanism 800 includes an elastic member 711 extending through a channel 747 on the end of cylindrical member 748. As shown in the cutaway view of FIG. 17, inside the channel is found closure mechanism 710 incorporating the same structure as shown in FIG. 14. In this embodiment there are two substantially identical frictional restrictive members 710. Restrictive frictional members 710 are stitched to the inside of channel 747 and placed near the opening where the free ends extend outward. Again, a Velcro hook or mating pad can be placed on the plain. The operation is similar as in connection with the prior embodiments. Rather than the inside of the channel, the self-contained restrictive members may be placed face downward on the outside of the channel so that the frictive components are not seen in operation. Likewise, they can be placed upright on top of the outside of the channel either as a component of the above closure mechanism or similar one-handed closure mechanism or may be added to the crushable body of a glove, article clothing or container as appropriate to shorten the dimension of that object.

Figure 18:
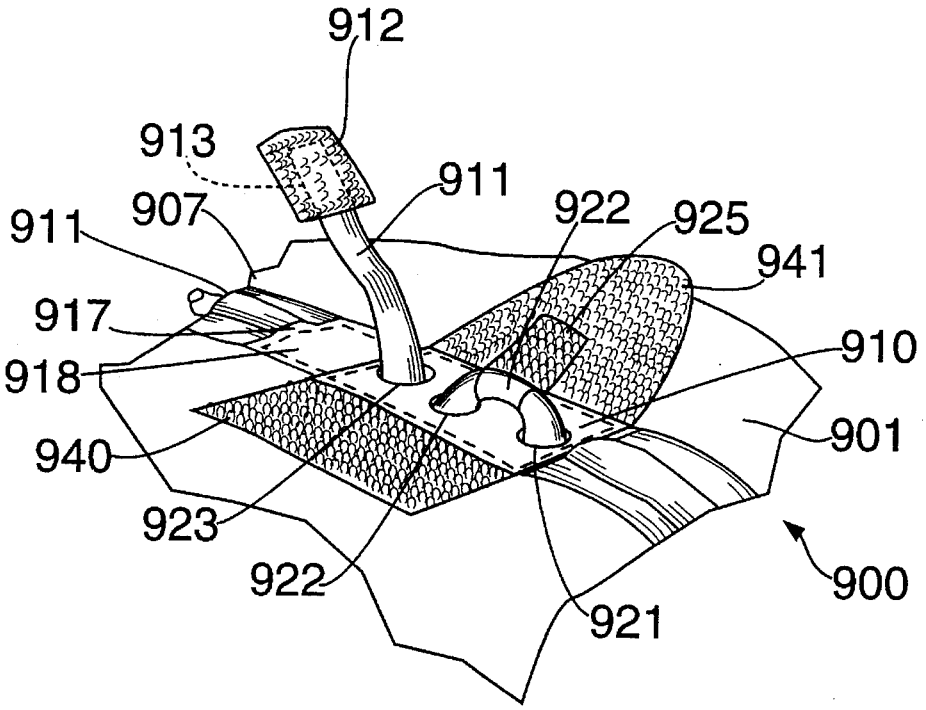
FIG. 18 is a cutaway perspective view of a closure and release mechanism constructed in accordance with another preferred embodiment of the invention.

Reference is next made to FIG. 18 wherein an improved one-handed closure and release mechanism constructed in accordance with another preferred embodiment of the invention, generally indicated as 900, is depicted. Closure release mechanism 900 is formed on a crushable generally tubular object 901. Proximate closure and release mechanism 900, generally tubular object 901 is itself generally crushable. Elastic stretchable member 911 has a fixed first end 917 secured by a covering piece 918 which, in a preferred embodiment, is sewn to the surface of object 901. Elastic stretchable member 911 enters a channel 907 and then encircles generally cylindrical crushable member 901. Elastic member 911 then extends under restrictive frictional member 910 and moves out of channel 907 and up above frictional restrictive member 910 through opening 921, returns below frictional restrictive member 910 through opening 922 and again returns above frictional restrictive member 910 through opening 923.

Openings 921, 922 and 923, in a preferred embodiment, are at least as large or larger than the cross-sectional area of stretchable elastic member 911 in its unstretched state. While it is possible for openings 921, 922 and 923 to be the same size or smaller than stretchable elastic member 911, the operation is simplified in the event that the dimensions of stretchable elastic member 911 in its unstretched state is less than the opening sizes for openings 921, 922 and 923.

Free end 913 of stretchable elastic member 911 has a handle 912 with a removable mating connector pad attached thereto. In addition, a fabric loop 925 encircles stretchable elastic member 911 above frictional restrictive member 910 between openings 921 and 922. Finally, a fixed pad 940 is secured to object 901, next to frictional restrictive member 910. Pad 940 has releasable connector mating pad such as Velcro hook or pile. Finally, a flexible guard piece 941, having connectors adapted to mate with pad 912 and mat 940 is secured on the other side of frictional restrictive member 910 and is sized so as to fold over the entire frictional closure member 910, free end of elastic cord member 911, including pad 912 and secure it all in place against mat 940 so that a clean exterior appearance is provided following closure of the closure mechanism 900.

In practice, one grips handle 912 between one's thumb and forefinger until no further pulling is possible, pressure is released, stretchable elastic member 911 locks within openings 921, 922 and 923 of frictional restrictive member 910 causing the portion of stretchable elastic member 911 in channel 907 to continue to shrink causing the crushing and shortening of channel 907 and the underlying and adjacent portions of object 901 to likewise reduce in size.

The one-handed release is accomplished by reopening flap 941 from mat 940 and gripping loop 925 and pulling it upwards to pull the excess portion of elastic stretchable member 911 beyond opening 923 into the loop between openings 922 and 921.

In a preferred embodiment pad 941 has an extended flap portion without mating connectors which assures that the entire mat 940 and other elements of one-handed releasable connector 900 is covered. Generally, an additional area beyond the furthest extent of the hook or pile connectors exists without any connector to facilitate the easy removal of flap 941.

Figure 19:
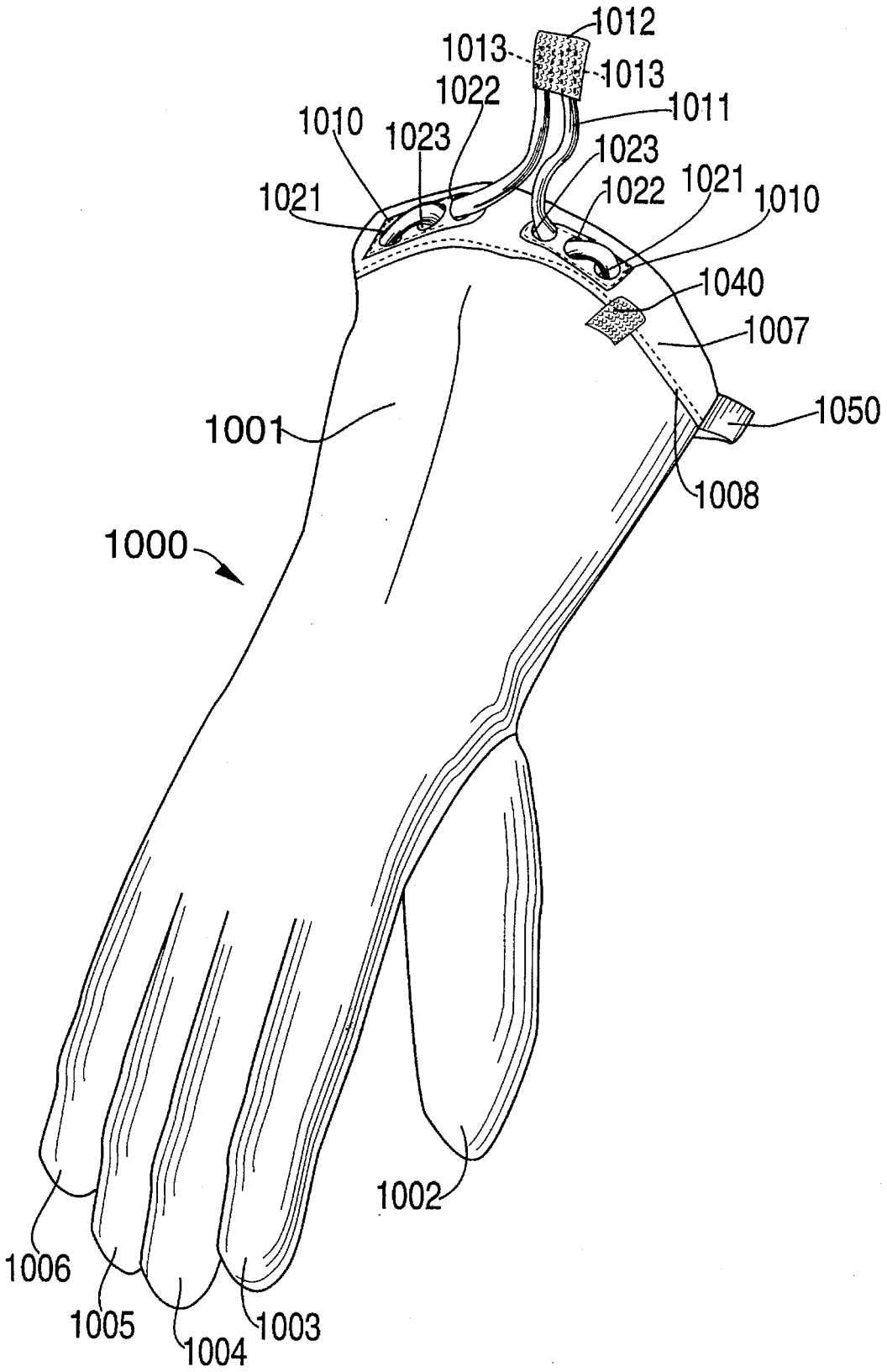
FIG. 19 is a perspective view of a closure and release mechanism constructed in accordance with another preferred embodiment of the invention.

Reference is next made to FIG. 19 wherein an improved one-handed closure and release mechanism constructed in accordance with another preferred embodiment of the invention, generally depicted as 1000, is depicted. Closure and release mechanism 1000 includes a glove 1001 having thumb 1002 and fingers 1003, 1004, 1005 and 1006. A channel region 1007 is recreated at the open gauntlet end by folding over a layer and sewing it in place with seam 1008. Two restrictive frictional members 1010 are secured in place near the back central line of the glove. Each of the restrictive frictional members 1010 has three openings, 1021, 1022 and 1023. An elastic stretchable member 1011 is threaded into the channel 1007 and first free end weaves outward through opening 1021, inward into the channel through opening 1022 and again outward through opening 1023. The same path through the other restrictive frictional member 1010 is achieved with the other free end 1013 of elastic stretchable member 1011. The two free ends 1013 are secured together with a gripping member 1012. Generally, a conventional method such as stitching is utilized. Gripping member 1012 has a releasable connector, such as a hook or pile connector pad affixed to gripping member 1012. A mating connector pad 1040 is sewn proximate the channel to receive the connector on gripping pad 1012. Finally, a gathered piece of leather or suitable fabric is sewn at the edge of channel 1007 between openings 1023 in the two frictional restrictive members 1010.

The use of the three opening frictional restricting members 1010 instead of the two opening embodiments as shown in other figures allows for the one-handed closure and release mechanism to be utilized in connection with glove structures which have lower friction surface components. Also, greater flexibility in the relative sizing of openings 1021, 1022 and 1023, relative to stretchable cord member 1011 are possible.

The operation of the closure mechanism 1000 operates as described above with respect to the other structures. One grips gripping member 1012 and pulls it until taut. When the pressure is released, the elastic stretchable member 1011 is trapped within frictional restrictive members 1010 and the stretched portion of elastic stretchable member 1011 between openings 1021 continues to shrink causing channel 1007 to crush and grip the wearer's hand, wrist or arm snugly. To release the grip, gripping member 1050 is gripped between the thumb and forefinger and pulled upwardly to cause the portion of stretchable cord member 1011 between openings 1023 and the free ends 1013 to reenter channel 1007, thereby lengthening the perimeter of chamber 1007.

As described above, there are various frictional restrictive structures which can be utilized either singly or in combination as a one-handed closure and release mechanism for gloves or mittens, generally tubular portions of garments, such as at the wrist, waist, ankles or head of the wearer or in connection with containers.

Also, many of these frictional restrictive members can be utilized in connection with reducing the dimensions of crushable members between two fixed points which need not be a complete or partial encirclement of a tubular member. This sort of adjustment would be useful in adjusting the sizing of a garment either as a component of a sizing scheme so that the garments could be made in fewer sizes and then be independently adjusted to the wearer's size and comfort requirements or as a means for making a garment particularly snug when in active use and thereafter being easily releasable for more comfortable fit when a snug fit is not required.

Certain of the restrictive frictional members are adapted to be essentially self-contained and independent of the structure or fabrics utilized and only dependent upon the characteristics of the frictional restrictive member or members and the elastic stretchable member.

Various different types of elastic stretchable members, such as shockcords may be utilized. Elastic cord member having generally circular cross-section, which are commonly available, have been shown. Likewise, certain stretchable cord members having generally rectangular or noodle-like shapes have also been shown. The concept is applicable to other cross-sectional dimensions of specialized shockcords which exist or may be developed. The basic requirement of the elastic shockcord member is that there is a general conservation of volume to the elastic stretchable member. The stretching is assumed to always be along the length of the elastic stretchable member. As the overall length of the elastic stretchable member increases, and the volume remains constant, then the volume per unit length must decrease. The only way that this can be accomplished is by a reduction in the average cross-sectional area of the stretchable cord member because volume for a given length is equal to the length time the average cross-sectional area. As the average cross-sectional area decreases, so does the outside surface area per unit length, which will have the positive effect of reducing the frictional cross-sectional area between the elastic stretchable member and the frictional restrictive member in the various embodiments noted.

Each of the embodiments shown relies on the characteristics of the elastic stretchable member sliding freely under the stress of a pulling force which, while not necessarily reducing the length of the stretchable cord member trapped between two frictional restrictive members or a single frictional restrictive member and a fixed end of the elastic stretchable member, reduces the relative percentage of the total volume and total length of the stretchable cord member there. Thereafter, the nature of the frictional restrictive members' operation is one in which there will be rapid frictional engagement and restriction of the stretchable member so that the trapped portion of the stretchable elastic member will then seek to return to its unstretched length which is less than the starting length of the stretchable elastic member. This force exerted along the length of the stretchable elastic member as it seeks to return to its unstretched state acts to crush the channel or portion of the garment or other object secured at the end of the trapped stretchable elastic member and causes that trapped portion of the object or garment to likewise reduce its dimension under the stress of the trapped elastic stretchable member. In the glove embodiments the trapped portion of the garment is usually the gauntlet or wrist portion of the glove which will crush and take on a shorter perimeter until it is snug around the wearer's hand, wrist or arm. As the trapped portion of the elastic stretchable member recompresses toward its unstretched state, its average cross-sectional area increases, further acting to lock the stretchable elastic member within the frictional restrictive members.

The one-handed release mechanisms associated with each of the closure mechanisms are adapted to increase the amount of the elastic stretchable member which is "trapped" so that the portion of the garment or object may uncrush and return to an increased perimeter and cross-sectional area.

Various other combinations of multi-opening frictional restrictive members may likewise be constructed with as many openings as deemed appropriated. Generally, there is no need for the openings in the frictional restrictive members to be tight or snug around the stretchable elastic member, even in its unstretched state. Generally, these openings may be made slightly larger so that when one pulls on the stretchable elastic member to enable the closure mechanism there is not undue resistance and the assembly of the closure mechanism is simplified.

Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It will also be understood that the following claims are intended to cover all of the generic and specific features of the invention, herein described, and all statements of the scope of the invention which, as a matter of language, might be said to fall there between.

What is claimed is:

1. A one-handed closure mechanism for selectively shortening a dimension of an item, comprising:

a stretchable elastic cord means for encircling at least a portion of an object along the dimension, having a first, outer contact surface perimeter in an unstretched state and a second outer contact surface perimeter in a stretched state, and said stretchable elastic cord means having two free ends;

base surface means for resting against the elastic cord means and providing frictional resistance to the movement of the elastic cord means;

restrictive guide means having at least two openings, each free end of the elastic cord means extending through at least two openings in the restrictive guide means, the elastic cord means having a first portion of its length which is formed by the two free ends and a second portion, making up the remainder of the length of the elastic cord means which is between the free ends and also encircles at least a portion of the object; the stretching of the elastic cord means by pulling on the free ends resulting in: the lengthening of the elastic cord means, the elastic cord means taking on the second outer contact surface perimeter at least proximate the openings in the restrictive guide means, the relative proportion of the length of the elastic cord means making up the second portion is reduced while the actual length of the second portion remains generally unchanged, the friction between the contact surface of the elastic cord means and the base surface means and the restrictive guide means being insufficient to prevent the increase in the actual length of the free ends; and the release of tension on the elastic cord means when the pulling is stopped, resulting in: the increase of the perimeter to the first outer surface perimeter; the increase in the relative friction between the elastic cord means and the base surface means and the restrictive guide means; the decrease in the length of the elastic cord means to a length greater than the original length of the elastic cord means, but the length of the elastic cord means between the free ends is substantially unchanged although in a stretched state, while the proportion of the elastic cord means which is between the free ends is reduced; and the stretched portion of the elastic cord means between the free ends biases the at least a portion of the object so that the at least a portion of the object's perimeter along the dimension between the free ends is reduced.

2. A one-handed closure mechanism for selectively shortening a dimension of a crushable member, comprising:

a stretchable elastic cord means encircling a crushable member, having a first, outer contact surface perimeter in an unstretched state and a second outer contact surface perimeter in a stretched state, and said stretchable elastic cord means having one fixed end, fixed to the member and one free end;

base surface means for resting against the elastic cord means and providing frictional resistance to the movement of the elastic cord means;

restrictive guide means having at least two openings, the free end of the elastic guide means extending through the two openings in the restrictive cord means, the elastic cord means having a first portion of its length which is formed by the free end and a second portion, making up the remainder of the length of the elastic cord means which is between the free end and the fixed end; the stretching of the elastic cord means by pulling on the free end resulting in: the lengthening of the elastic cord means, the elastic cord means taking on the second outer contact surface perimeter at least proximate the openings in the restrictive guide means, the relative proportion of the length of the elastic cord means making up the second portion being reduced while the actual length of the second portion remains substantially unchanged, the friction between the contact surface of the elastic cord means and the base surface means and the restrictive guide means being insufficient to prevent the increase in the actual length of the free ends; and the release of tension on the elastic cord means when the pulling is stopped, resulting in: the increase of the perimeter to the first outer surface perimeter; the increase in the relative friction between the elastic cord means and the base surface means and the restrictive guide means; the decrease in the length of the elastic cord means, but to a length greater than the original length of the elastic cord means when the friction between the elastic cord means and the base support means and the restrictive guide means increases to stop the further movement of the free end through the openings in the restrictive covering means, but the length of the elastic cord means between the free ends while in a substantially unchanged length is still in a stretched state, although the proportion of the elastic cord means between the free ends is reduced; and the stretched portion of the elastic cord means fixed by friction between the free ends biases the member so that the object's perimeter between the free end and the fixed end of the elastic cord means is reduced.

3. A one-handed closure mechanism for selectively shortening a dimension of a crushable member, comprising:

a stretchable elastic cord means encircling a portion of a crushable member, having a first, outer contact surface perimeter in an unstretched state and a second, smaller, outer contact surface perimeter in a stretched state, and said stretchable elastic cord means having one fixed end, fixed to the member and one free end;

base surface means for resting against the elastic cord means and providing frictional resistance to the movement of the elastic cord means;

restrictive guide means, secured to the base surface means, having at least two openings, the elastic cord means extending through the two openings in the restrictive cord means with the free end extending from one of the openings, the elastic cord means having a first portion of its length which is formed by the free end extending beyond the restrictive guide means and a second portion, making up the remainder of the length of the elastic cord means which is between the free end and the fixed end; the stretching of the elastic cord means by pulling on the free end resulting in: the lengthening of the elastic cord means, the elastic cord means taking on the second outer contact surface perimeter at least proximate the openings in the restrictive guide means, the relative proportion of the length of the elastic cord means making up the second portion being reduced while the actual length of the second portion remains substantially unchanged, the friction between the contact surface of the elastic cord means and the base surface means and the restrictive guide means being insufficient to prevent the increase in the actual length of the free end; and the release of tension on the elastic cord means after pulling on the free end, resulting in: the increase of the outer surface perimeter to the first outer surface perimeter; the increase in the relative friction between the elastic cord means, and the base surface means and the restrictive guide means until the friction prevents further movement of the elastic cord means relative to the openings; the decrease in the length of the elastic cord means, but to a length greater than the original length of the elastic cord means, when the friction between the elastic cord means and the base support means and the restrictive guide means increases to stop the further movement of the free end through the openings in the restrictive guide means, but the length of the second portion of the elastic cord means, while in a substantially unchanged length, remains in a stretched state, although the proportion of the elastic cord means forming the second portion is reduced; and the stretched portion of the elastic cord means fixed by friction forming the second portion biases the crushable member so that the object's portion between the restrictive covering means and the fixed end of the elastic cord means is reduced.

4. The one-handed closure mechanism of claim 3 wherein the restrictive guide means is formed as a generally rectangular member having two substantially rounded openings therein, the openings having an opening perimeter greater than the first, outer contact surface perimeter in an unstretched state for the stretchable elastic cord means.

5. The one-handed closure mechanism of claim 3 wherein the restrictive guide means is formed with three openings, arranged in a generally co-linear form and the stretchable elastic cord means extends continuously through each of the openings in the restrictive guide means.

6. The one-handed closure mechanism of claim 5 wherein the restrictive guide means includes two of the restrictive guide members, each of which has three openings therein.

7. The one-handed closure mechanism of claim 3 further including release means secured to the restrictive guide means for extending the second portion of the elastic cord means.

8. The one-handed closure mechanism of claim 7 wherein the release means includes a handle secured to the restrictive guide means.

9. The one-handed closure mechanism of claim 3 further including a connection pad secured to the free end of the stretchable elastic cord means, the connection pad having a mating member fixed thereon, and a mating connector is attached to one of the outer surface of the crushable member and to the stretchable elastic cord means, the mating member being adapted to releasably couple with the mating connector so that the free end of the stretchable elastic cord means is held in place.

10. The one-handed closure mechanism of claim 9 wherein the mating connector is secured to the second portion of the stretchable elastic cord means and is also adapted to aid in releasing the shortening of the dimension of the crushable member.

11. The one-handed closure mechanism of claim 3 wherein the base surface means is stitched to an outer surface of the crushable member.

12. The one-handed closure mechanism of claim 3 further including a channel means for enclosing the stretchable elastic cord means except where the stretchable elastic cord means extends between the base surface means and the restrictive guide means.

13. A one-handed closure mechanism for an open-ended container, comprising:

channel means formed of a crushable material adapted to gather when the channel is shortened from an open length to a closed length, coupled at or near the end of the container for forming a channel corresponding to a distance around the open end of the container, the channel having at least two openings;

stretchable cord means, within the channel and extending outward of the channel through the channel openings, having an unstretched cross-sectional area and a stretched cross-sectional area, the unstretched cross-sectional area being larger than the stretched cross-sectional area;

restrictive passage means, secured to the channel means, having at least two openings, corresponding to the openings in the channel means;

the stretchable cord means extending through the openings in the channel and restrictive passage means and through the channel so that the stretchable cord means extends around the open end of the container;

whereby pulling on the portion of the stretchable cord means extending out of one of the openings causes the stretchable cord means to take on the stretched cross-sectional area, at least proximate the restrictive passage means to reduce the frictional resistance of the stretchable cord means so that the stretchable cord means freely slides in the channel and then releasing the stretchable cord means causes the stretchable cord means to return to the unstretched cross-sectional area proximate the openings, thereby increasing the friction between the restrictive passage means and the stretchable cord means so that the portion of the stretchable cord means trapped in the channel is substantially unchanged, but is still stretched, and as that trapped portion unstretches, it shortens the channel to a closed length less than the open length and secures the open end of the container in a closed position.

14. The one-handed closure mechanism of claim 13 wherein the restrictive passage means includes a Y-shaped member, wherein the two spread points of the Y are secured to a pair of openings of the channel means, and the Y-shaped member has two pairs of openings arranged in a generally colinear orientation through which extend each of the portions of the stretchable cord means extending outward of the channel.

15. The one-handed closure mechanism of claim 14 wherein the ends of the stretchable cord means extending through the restrictive passage means are secured together by a handle means.

16. The one-handed closure mechanism of claim 15 wherein the handle means is formed as a material folded over the end portions of the stretchable cord means and secured to itself.

17. The closure mechanism of claim 13 wherein the stretchable cord means includes a shockcord having two free ends, the free ends of the shockcord extending beyond the end of the channel.

18. The closure mechanism of claim 17 wherein the free ends are coupled to a handle means for preventing entry of the free end into the channel and for providing a gripping surface.

19. The closure mechanism of claim 17 further comprising release means for enabling enlargement of the channel from the closed length to the opened length, coupled to the container proximate the restrictive guide means.

20. The closure mechanism of claim 19 wherein the release means includes a handle member, adapted to be gripped between two fingers.

21. The closure mechanism of claim 20 wherein the release means includes a pliable sheet folded over a portion of the container and coupled to itself through the container.

22. A one-handed closure mechanism for a glove, comprising:

channel means for forming a channel at or near a hand opening of the glove having an opened length corresponding to an opened distance around the hand opening, the channel terminating with at least one opening;

stretchable cord means, within the channel extending outwardly beyond the opening, having an unstretched cross-sectional area and a stretched cross-sectional area, the unstretched cross-sectional area being larger than the unstretched cross-sectional area;

Restrictive guide means, coupled to the channel means, proximate to the opening, for frictionally restricting the movement of the stretchable cord means, the restrictive guide means having at least two passages, for passing the stretchable cord means from either the inside of the channel to the outside of the channel or vice versa, and frictional surfaces for frictionally engaging with the stretchable cord means;

whereby pulling on the portion of the stretchable cord means extending out of one of the openings causes the stretchable cord means to take on the stretched cross-sectional area proximate the restrictive guide means to freely slide in the channel and then releasing the stretchable cord means causes the stretchable cord means to take on the unstretched cross-sectional area proximate the restrictive guide means thereby increasing the frictional engagement and locking the stretchable cord means in the openings and shortening the channel means to a closed distance less than the opened length and securing the open end in a closed position.

23. A one-handed closure mechanism for a tubular member, comprising:

channel means coupled around the tubular member at a closure location for forming a channel of an opened length, corresponding to a distance around the tubular member at the closure location, having a channel cross-sectional area and terminating with two openings;

stretchable cord means, within the channel and extending outward beyond both openings, having an unstretched cross-sectional area and a stretched cross-sectional area, the unstretched cross-sectional area being larger than the stretched cross-sectional area;

Restrictive guide means, coupled to the channel means, proximate to the opening, for frictionally restricting the movement of the stretchable cord means, the restrictive guide means having at least two passages, for passing the stretchable cord means from either the inside of the channel to the outside of the channel or vice versa, and frictional surfaces for frictionally engaging with the stretchable cord means;

whereby pulling on the portion of the stretchable cord means extending out of one of the openings causes the stretchable cord means to take on the stretched cross-sectional area proximate the restrictive guide means and to freely slide in the channel and then releasing the stretchable cord means causes the stretchable cord means to take on the unstretched cross-sectional area proximate the restrictive guide means thereby increasing the frictional engagement and locking the stretchable cord means in the openings and the biasing force of the stretched portion of the stretchable cord means within the channel attempting to return to its unstretched state crushing and shortening the channel means to a closed distance less than the opened length and securing the open end in a closed position.

24. The closure mechanism of claim 23 further including release means for lengthening the channel from the closed length to the opened length, coupled to the tubular member proximate the two openings.

25. The closure mechanism of claim 24 wherein the release means includes a handle adapted to be operated by one hand.

* * * * *